United States Patent [19]

Levis

[11] 4,083,308

[45] Apr. 11, 1978

[54] PROJECTILE FUZES

[75] Inventor: Peter Stanley Levis, Bramhall, England

[73] Assignee: Ferranti Limited, Hollinwood, England

[21] Appl. No.: 471,501

[22] Filed: May 20, 1974

[30] Foreign Application Priority Data

May 19, 1973 United Kingdom ..... 23996/73

[51] Int. Cl.[2] ..... F42C 11/06

[52] U.S. Cl. ..... 102/70.2 R

[58] Field of Search ..... 102/70.2 R, 70.2 P; 244/3.13

[56] References Cited

U.S. PATENT DOCUMENTS

| | | | |
|---|---|---|---|
| 3,113,305 | 12/1963 | Trounson et al. | 102/70.2 P |
| 3,500,746 | 3/1970 | Ambrosini | 102/70.2 R |
| 3,670,652 | 6/1972 | Ziemba | 102/70.2 R |
| 3,714,898 | 2/1973 | Ziemba | 102/70.2 R |
| 3,741,502 | 6/1973 | Schroader et al. | 244/3.13 |
| 3,844,217 | 10/1974 | Ziemba | 102/70.2 R |

*Primary Examiner*—Charles T. Jordan

*Attorney, Agent, or Firm*—Cameron, Kerkam, Sutton, Stowell & Stowell

[57] ABSTRACT

A projectile fuze contains a radio receiver, an oscillator, a counter and detonation means activated by an output signal from the counter. After firing the oscillator is started for a unit time period defined by successive signals transmitted to the projectile from a transmitter. The number of oscillations counted in the unit time period is multiplied by the number of unit time periods until detonation, calculated from range data, and transmitted to the projectile to set a counting limit for the counter before it produces an output signal. The signal containing the range data is used to clear the counter and restart the oscillator and may be used to render the radio receiver unresponsive to further signals. The projectile may have a booster or air-brake which is operated in flight by means of a second counter output signal or an output signal from an additional counter.

10 Claims, 1 Drawing Figure

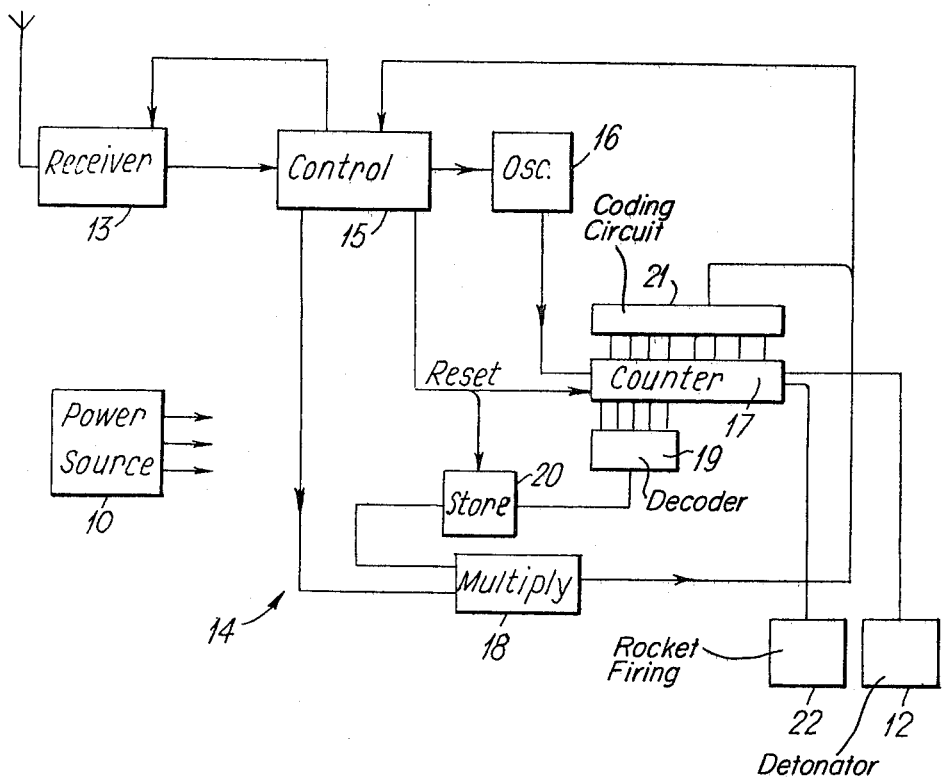
Receiver
13
Control
15
Osc.
16
Coding Circuit
21
Reset
Counter
17
19
Decoder
Power Source
10
Store
20
Multiply
18
14
Rocket Firing
22
12
Detonator

PROJECTILE FUZES

This invention relates to projectile fuzes and in particular to time delay fuzes arranged to detonate a projectile at a preset time after launch, the preset time being calculated from the range of the target.

Time delay fuzes are known including mechanical clocks which are set prior to the launch of the projectile and are brought into operation at launch. Such fuzes have the disadvantages that in the case of a shell, say, the time delay has to be set before the shell is loaded into the gun and no account can be taken of movement of the target in the period between the setting of the fuze and the firing of the shell. Also, to set the delay in accordance with the most recent range data the delay is set immediately before firing so that shells are loaded and fired at a slow rate.

It is an object of the present invention to provide a time delay fuze for a projectile which overcomes the above disadvantages.

According to one aspect of the present invention a time delay fuze for a projectile includes an information receiver for receiving information signals transmitted by a controlling source and rendered operable upon the firing of the projectile, timing means including an oscillator and activated by signals received by the receiver to respond to the output of the oscillator for a time interval defined by said received signals, and detonation means operable at the end of the timing interval to detonate the fuze.

According to another aspect of the present invention there is provided a projectile containing a time delay fuze as described in the preceding paragraph.

Also according to the present invention there is provided a weapon system comprising a projectile as described in the immediately preceding paragraph and a transmitter of signals to the projectile in flight.

Preferably signals received during the timing interval are rendered ineffective. The timing means may also include a counter, the counter being set, by means of said received signals, to count a number of oscillations produced by the oscillator.

According to another aspect of the present invention a method of detonating a projectile fuze at a predetermined time after firing the projectile, the projectile fuze containing a receiver of transmitted information signals, an oscillator, a counter of oscillations produced, detonation means and means for setting a counting limit in the counter at which a signal to the detonation means is produced, comprises the steps of transmitting a first information signal to start the oscillator, transmitting a second information signal after a predetermined time period to stop the oscillator, the counter providing an indication of the number of oscillations produced in said unit time period, transmitting a third information signal, representative of the number of unit time periods to the end of the delay period, and causing this number to be multiplied by the number of oscillations counted in said unit time period, setting the value of the product as the counting limit of the counter, clearing the counter of the previously counted oscillations and restarting the oscillator.

The present invention will now be described, by way of example, with reference to the accompanying drawings in which the single FIGURE shows in block form the receiving and timing means within the fuze according to the present invention. The following description relates to a shell projectile but is equally applicable to other types of projectile such as a rocket.

The fuze is contained within the shell and is powered from an electrical source 10 activated by launch of the shell. The source provides power for an electrical detonator 12, a radio receiver 13 and a delay timing means 14. The receiver and timing means are arranged to become operable as soon as power is available, that is, immediately subsequent to the shell being fired. The timing means comprises control means 15, an oscillator 16, a counter, 17, of oscillator pulses, and a multiplying circuit 18.

Operation of the fuze may be considered conveniently in two parts. Firstly, the reception of information from which the delay time is calculated and secondly, the calculation of, and timing of, the delay.

The receiver 13 has a high- and a low-sensitivity state and initially it is in the low-sensitivity state such that immediately after firing it is able to receive only transmissions directed at it by means of a directional aerial located near to the gun. This arrangement prevents adjacent gun systems from interfering with each other.

The receiver is arranged to receive a signal directed to it immediately after firing and which is passed to the control means 15 and is in the form of a coded signal. The control means stores the code and interrogates each subsequent signal which must be prefixed by the code before the control means will recognise it. Once the control means has stored the code, it changes the sensitivity of the receiver to the high state. Thus the receiver is able to receive information while the shell is travelling away from the gun but is immune from unwanted signals from adjacent gun sites or from the enemy because of the prefix code.

The timing means is now ready to receive information relating to the delay from the launch time until the fuze is to be detonated, taking account of the time into flight of the shell.

Preceded by the code, the control means 15 receives a first information signal which starts the oscillator 16. The oscillator produces a train of pulses at a repetition frequency F and these pulses are fed into the counter 17. The oscillator is operated until a second information signal is received after an interval T, which interval represents a unit time period. The number of oscillator pulses $N(=F \times T)$ counted is read from the counter by way of a decoder 19 and stored in a temporary store 20.

After the second information signal has been received and used to stop the oscillator, a third information signal is transmitted. The third signal is in pulse-digital form and comprises a number M which has been calculated from the target range and muzzle velocity of the shell at firing to give the fuze delay time interval in multiples of the unit time period T.

The signal comprising the number M is fed to the control means 15 which responds by producing a signal to render the receiver unresponsive to further signals and prevent any subsequent signal from reaching the control means. The number is fed to the multiplying circuit 18 with the number N from the store 20. The resultant number $(N \times M)$ is fed to a coding circuit 21 and to the control means 15. The coding circuit 21 sets the counter 17 to a counting limit of $(N \times M)$ pulses at which stage of the count an output signal is provided to the detonation means 12. The control means, on receipt of the signal from the multiplying circuit, resets the counter and restarts the oscillator 16.

Pulses from the oscillator are fed to the counter 17 which counts until (N × M) pulses have been received when the detonation means is activated and the shell explodes. The time taken to count the (N × M) pulses is the delay time interval required between firing and the desired detonation of the fuze and is independent of the actual frequency of the oscillator.

As stated above, in determining the delay time interval M, account is taken of the time of the shell into its flight when the counter begins to count after calculating the number of pulses to be counted, so that the detonation may be accurately known with respect to the target range.

A laser ranging device may be incorporated with the gun to give an accurate value for the range and coupled with a knowledge of the muzzle velocity of the shell the required time delay can be calculated with accuracy. If the target is moving at high speed this is taken into account in estimating range and delay times and each shell fired is fed with updated information after firing and not while it is waiting to be loaded into the gun. The gun can thus be of an automatic nature and fire a burst of shells in rapid succession from a magazine.

The time delay required is greatly dependent on the muzzle velocity of the shell and this can vary from shell to shell. Apparatus is available to measure accurately the speed at which a shell emerges from the gun but hitherto such knowledge, after firing, was of no tactical use as the delay time interval was set prior to firing. With a fuze according to the present invention such an accurate measurement of muzzle velocity coupled with accurate ranging by laser can be combined to provide an accurately known delay time interval.

The accuracy of the initial calculation of the delay time interval is continued in the fuze by calibrating the oscillator after firing. The only requirement of the oscillator is for it to remain stable in frequency throughout the flight, irrespective of whether the shock of firing causes the frequency to change from a nominal value assigned to it.

The sophistication of such a system is justified by certain types of target where it is necessary to fire several shells in quick succession and at short notice. Using shells incorporating the time delay fuze according to the present invention, the shells can be loaded into a magazine and fired in the right direction immediately that a target is engaged. The delay time interval, unique to each shell, is inserted after firing.

It is known in long range ballistics to use a boosted projectile, that is, a projectile which contains a small rocket motor ignited at some point in its flight to extend, or even reduce, the initial range by altering its trajectory.

In a shell containing a time delay fuze according to the present invention the counter 17 may be arranged to provide a second output signal to rocket firing means 22. The limit to which the counter 17 is set to activate the rocket motor may be incorporated with the information relating to range data fed to the coding circuit 21. The rocket fires for a set time and produces a known thrust; the effect of the thrust on the shell is controlled by the position in the trajectory at which the rocket is fired.

Alternatively there may be provided a duplicate counter 17 (not shown) having its own coding circuit and which is set to the required counting limit by means of the received signals and the control means 15, oscillator 16 and multiplier 18. The shell may alternatively be provided with air braking means such as retractable flaps, operable to control the drag on the shell.

Instead of range data being transmitted to the shell, immediately after firing, from a transmitter located with the gun, it may be transmitted from portable equipment at a advanced observation point or even from an aircraft, such as a helicopter. Corrections following observations of 'sighting' rounds may be inserted by the observer for subsequent rounds, relying on the prefix code to prevent jamming by the enemy. Alternatively the information could be relayed to the transmitter located at the gun and be transmitted to the shell in the usual way.

Similarly it would be possible for the setting up of a "radio curtain" by an observer at a precisely known distance from the target so that all rounds would be ranged accurately. This complicates the correction for muzzle velocity but the error is reduced by the ratio of the observer-to-target range compared with the gun-to-target range.

The invention has been described above for a radio receiver; other forms of receiver may be used, for instance, an optical detector, receiving information in the form of a modulated light beam. Similarly, the oscillator may produce other than pulses, the oscillations then either being converted to pulses or counted in some other manner.

It will be appreciated that a system employing a fuze according to the present invention is more complex than a conventional one but in practice the added complexity is in the delay calculating and transmitting apparatus coupled to the gun. The circuitry contained within the fuze can be made simply and cheaply from few components using large scale integration (L.S.I.) techniques of integrated circuit technology. The analogue receiver 13 and the digital delay timing means 14 may even be formed on a single integrated circuit chip. Using such a construction a fuze according to the present invention could be manufactured for less than the cost of a conventional mechanically timed fuze.

What I claim is:

1. A time delay fuze for causing detonation of a weapon projectile after a predetermined delay period comprising (i) an information receiver for receiving information signals and rendered operative upon firing of the projectile, (ii) timing means operable in response to signals received by the receiver to determine said predetermined delay period and comprising (a) an oscillator, (b) a counter of oscillator signals to a counter limit, (c) control means responsive to a first received information signal to start the counting of oscillations and responsive to a second information signal received after a predetermined unit time period to stop the counting of oscillations, (d) multiplication means responsive to a third received information signal representative of the number of unit time periods to the end of the delay period to provide a counter counting limit signal representative of the product of the number of unit time periods and the number of oscillations counted in said predetermined unit time period, and (e) coding means responsive to the counting limit signal to set the counting limit of the counter to the number of oscillations represented by the counting limit signal, and (iii) detonation means operable at the end of the delay period.

2. A time delay fuze as claimed in claim 1 in which the receiver is arranged to have a low-sensitivity state upon firing of the projectile and responsive to an initial received signal to change to a high-sensitivity state.

3. A time delay fuze as claimed in claim 1 which includes interrogation means operable to reject any signal received that is not identified by a predetermined code signal.

4. A time delay fuze as claimed in claim 3 in which the interrogation means is rendered operable upon receipt of a signal containing the predetermined code signal.

5. A time delay fuze as claimed in claim 1 in which the oscillator is operable to provide a train of pulses and in which at least the third information signal is in pulse-digital form.

6. A time delay fuze as claimed in claim 1 in which the information signals are transmitted at radio frequency.

7. A time delay fuze as claimed in claim 1 including means responsive to a final information signal to render the timing means unresponsive to signals received after said final information signal.

8. A time delay fuze as claimed in claim 1 including means responsive to an information signal received in flight containing information additional to the third information signal to change the speed of the projectile at a time, defined by said information signal received in flight, between the reception of said information signal received in flight and the end of the delay period.

9. A method of detonating the fuze of a projectile at a predetermined time after firing of the projectile, the projectile fuze containing a receiver of transmitted information signals, an oscillator, a counter of oscillations produced, detonation means and means for setting a counting limit in the counter at which a signal to the detonation means is produced, the method comprising the steps of transmitting a first information signal to start the counting of oscillations, transmitting a second information signal after a predetermined unit time period to stop the counting of oscillations, the counter providing an indication of the number of oscillations produced in said unit time period, transmitting a third information signal, representative of the number of unit time periods to the end of the delay period, and causing this number to be multiplied by the number of oscillations counted in said unit time period, setting the value of the product as the counting limit of the counter, clearing the counter of the previously counted oscillations and restarting the counting of oscillations.

10. A method of detonating a projectile fuze as claimed in claim 9 which further includes the step of rendering the receiver unresponsive to signals after reception of said third information signal.

* * * * *